US005649487A

United States Patent [19]

Zuber

[11] Patent Number: 5,649,487

[45] Date of Patent: Jul. 22, 1997

[54] DEVICE FOR PULLING OFF AND HOLDING A PRINTING PLATE REMOVED FROM A PLATE CYLINDER OF A ROTARY PRINTING PRESS

[75] Inventor: Mathias Zuber, Helmstadt-Bargen, Germany

[73] Assignee: Heidelberger Druckmaschinen AG, Heidelberg, Germany

[21] Appl. No.: 611,875

[22] Filed: Mar. 7, 1996

[30] Foreign Application Priority Data

Mar. 7, 1995 [DE] Germany ..... 195 07 908.6

[51] Int. Cl.[6] ..... B41L 47/14

[52] U.S. Cl. ..... 101/477; 101/216

[58] Field of Search ..... 101/212, 216, 101/378, 382.1, 383, 415.1, 477, DIG. 36

[56] References Cited

U.S. PATENT DOCUMENTS

| | | | |
|---|---|---|---|
| 4,368,668 | 1/1983 | Johne et al. . | |
| 5,218,907 | 6/1993 | Komori et al. | 101/477 |
| 5,289,773 | 3/1994 | Saito et al. . | |
| 5,289,775 | 3/1994 | Spiegel et al. | 101/477 |
| 5,293,820 | 3/1994 | Maejima et al. | 101/477 |
| 5,361,699 | 11/1994 | Compera . | |
| 5,443,006 | 8/1995 | Beisel et al. . | |
| 5,454,317 | 10/1995 | Kobler et al. | 101/477 |
| 5,495,805 | 3/1996 | Beisel et al. | 101/477 |
| 5,511,478 | 4/1996 | Lindner et al. | 101/477 |

FOREIGN PATENT DOCUMENTS

| | | |
|---|---|---|
| 0653301A1 | 5/1995 | European Pat. Off. . |
| 4130359A1 | 3/1993 | Germany . |
| 4214047 | 4/1994 | Germany . |
| 3-97563 | 4/1991 | Japan . |
| 4-284252 | 10/1992 | Japan . |
| 94/06630 | 3/1994 | WIPO . |

*Primary Examiner*—Ren Yan

*Attorney, Agent, or Firm*—Herbert L. Lerner; Laurence A. Greenberg

[57] ABSTRACT

A combination of a rotary printing press having a plate cylinder, and a device for pulling off and holding a printing plate removed from the plate cylinder of the rotary printing press includes a printing unit tower of the rotary printing press which contains the respective plate cylinder, the pull-off and retaining device being disposed on the printing unit tower.

6 Claims, 3 Drawing Sheets

DEVICE FOR PULLING OFF AND HOLDING A PRINTING PLATE REMOVED FROM A PLATE CYLINDER OF A ROTARY PRINTING PRESS

BACKGROUND OF THE INVENTION

Field of the Invention

The invention relates to a device for pulling off and holding a printing plate which has been removed from a plate cylinder of a rotary printing press.

It has become known heretofore from the published Japanese Patent Document Hei 3-97563 to secure the rear or trailing edge of a printing plate on a suction head in order to remove the printing plate from a plate cylinder of a printing press. The suction head is secured to a cable which is wound up by a spring-loaded winding roller. The winding roller is secured to an adjacent printing unit housing.

A disadvantage of the printing plate removal device described in the aforementioned Japanese Patent Document Hei 3-97563 is that the device cannot function or operate automatically, because the suction head must be applied by a human operator.

SUMMARY OF THE INVENTION

It is accordingly an object of the invention to provide a device for pulling off and retaining a printing plate removed from a plate cylinder of a printing press which operates automatically.

With the foregoing and other objects in view, there is provided, in accordance with the invention, in combination, a rotary printing press having a plate cylinder, and a device for pulling off and holding a printing plate removed from the plate cylinder of the rotary printing press, the rotary printing press comprising a printing unit tower containing the respective plate cylinder, the pull-off and holding device being disposed on the printing unit tower.

In accordance with another feature of the invention, the device for pulling off and holding a printing plate includes a take-up element for a leading and trailing edge, respectively, of the printing plate.

In accordance with a further feature of the invention, the device for pulling off and holding a printing plate includes a locking element cooperatively engageable with the take-up element.

In accordance with an added feature of the invention, the device for pulling off and holding a printing plate includes adjusting members engageable with the take-up and the locking elements for shifting the take-up element and the locking element between a "take-up position" and a "holding position".

In accordance with an additional feature of the invention, the adjusting members include a swivelably supported work cylinder, a swivelably supported control lever, a coupler disposed on the control lever, a first actuating lever disposed on the coupler, and a stationary, swivelably arranged second actuating lever.

In accordance with yet another feature of the invention, the first actuating lever carries the locking element at a free end thereof, and the second actuating lever carries the take-up element.

In accordance with yet a further feature of the invention, the first and the second actuating levers are supported so as to be swivelable counter to one another.

In accordance with yet an added feature of the invention, the device for pulling off and holding a printing plate includes guide elements mounted on the printing unit tower for feeding the leading and the trailing edge, respectively, of the printing plate to the take-up element.

In accordance with yet an additional feature of the invention, the take-up element is a hook.

In accordance with a concomitant feature of the invention, the take-up element is a hook formed with an opening, and the locking element is a cover for covering the opening.

An advantage of the invention is that the releasing or untensioning and the holding or retaining of the printing plate are performed fully automatically, requiring no intervention by a human operator. Because a new printing plate can be made ready, moreover, in a separate holding device, it is accordingly possible to eliminate the time for removing and transporting the old printing plate away and to begin immediately to fasten and tauten the new printing plate in place. The entire printing-plate changing is thereby speeded up.

Another advantage of the invention is that the holding device is disposed on the same printing unit wherein the respective plate cylinder is supported, so that the removed printing plate does not block the region between the printing units of the rotary printing press.

In an advantageous construction of the device according to the invention, a take-up hook with holding protection is provided, wherein the removed printing plate is suspended and secured against slipping out.

Preferably a bidirectional or double-action work cylinder is provided which effects the opening of the lock and the transporting of the printing plate away from the plate cylinder to a holding or retention position.

Other features which are considered as characteristic for the invention are set forth in the appended claims.

Although the invention is illustrated and described herein as embodied in a device for pulling off and holding a printing plate removed from a plate cylinder of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
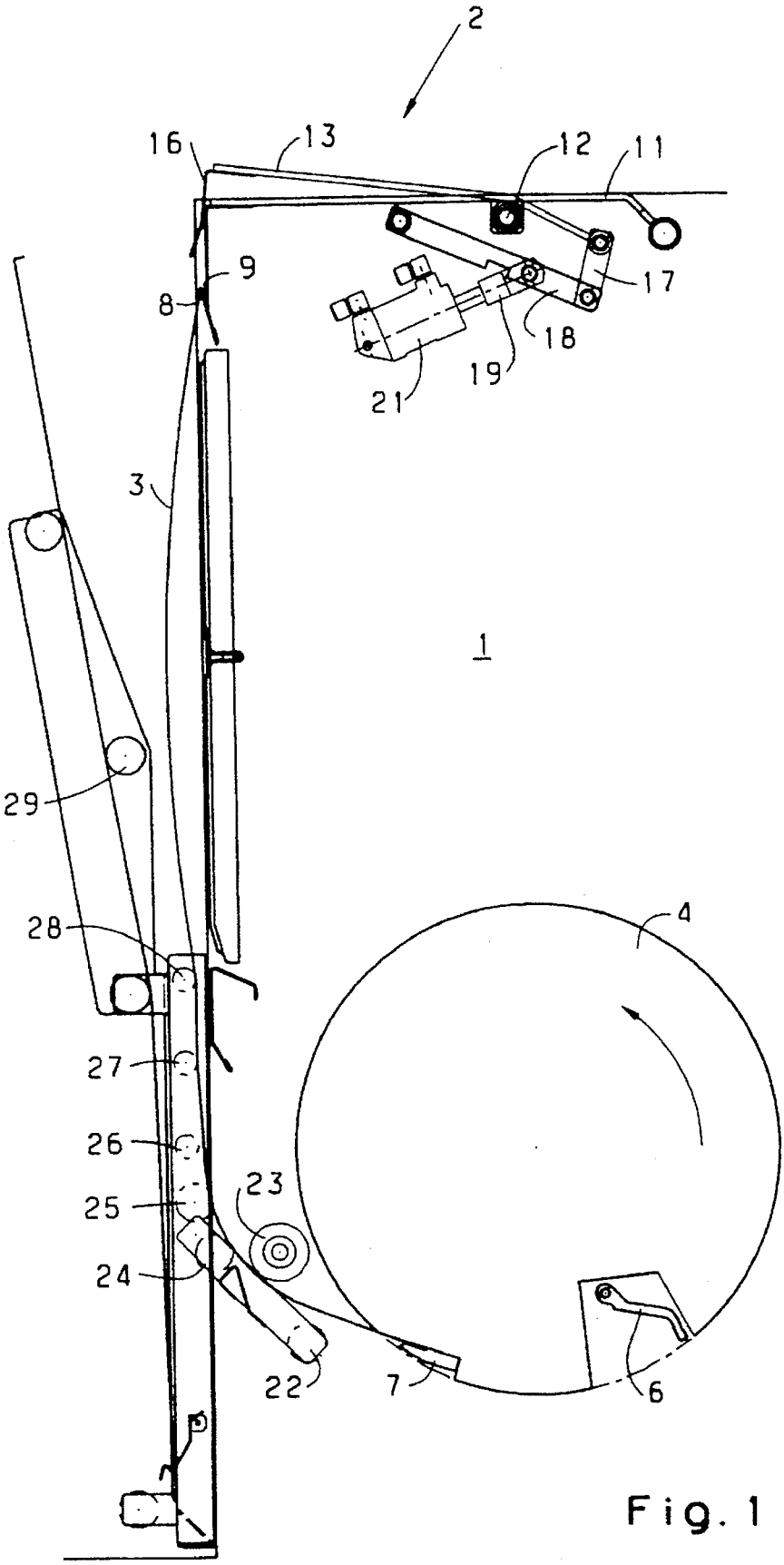
FIG. 1 is a diagrammatic side elevational view of a printing unit tower having a plate cylinder and a printing plate holding device according to the invention in a "printing plate take-up or receiving position"

Referring now to the drawings and, first, particularly to FIG. 1 thereof, there is shown therein a printing unit tower 1 of a rotary printing press having a device 2 in an upper region thereof for pulling off and holding or retaining a printing plate 3 which has been unwound from a plate cylinder 4 and released from clamping and tensioning devices 6 and 7, respectively, provided on the plate cylinder 4. Preferably, at least two pull-off and holding devices 2 disposed mutually adjacent and parallel to one another are provided per printing unit tower 1. In the interest of clarity, the device according to the invention is described hereinafter with respect to only one type of device.

The pull-off and holding device 2 has a take-up or receiving hook 8 formed with an opening 9 facing generally upwardly. The hook 8 has a width which is approximately equivalent to the width of the printing plate. The hook 8 is secured on a free end of an actuating lever 11 horizontally disposed in a "receiving or take-up position" for the printing plate 3. At an end remote from the hook 8, the actuating lever 11 is swivelably supported in a bearing 10 on the printing unit tower 1. The actuating lever 11 has a bearing pin 12 for a further actuating lever 13, which is swivelably supported on the bearing pin 12. At a free end thereof, the actuating lever 13 carries a cover 16, which is bringable into contact with the opening of the hook 8 so that closure of the opening 9 occurs. An end of the actuating lever 13 facing away from the cover 16 is swivelably supported on a coupler 17.

The other end of the coupler 17 is swivelably supported at one end of a control lever 18, and the other end thereof is swivelably supported on the printing unit tower 1. An end of a piston rod 19 of a bi-directional work cylinder 21, which is swivelably supported on the printing unit tower 1, engages with the control lever 18 approximately midway along the length thereof.

The printing plate 3, released by the clamping and tensioning or tautening devices 6 and 7, respectively, of the plate cylinder 4, is fed by feed rollers 22 to 29 to the hook 8 and automatically suspended by the rear or trailing edge of the printing plate on the hook 8. The hook 8 is in the "receiving or take-up position". This is produced by a first working position of the work cylinder 21 wherein the piston rod 19 is driven inwardly so far that the actuating lever 13 is swiveled relative to the actuating lever 11.

Figure 2:
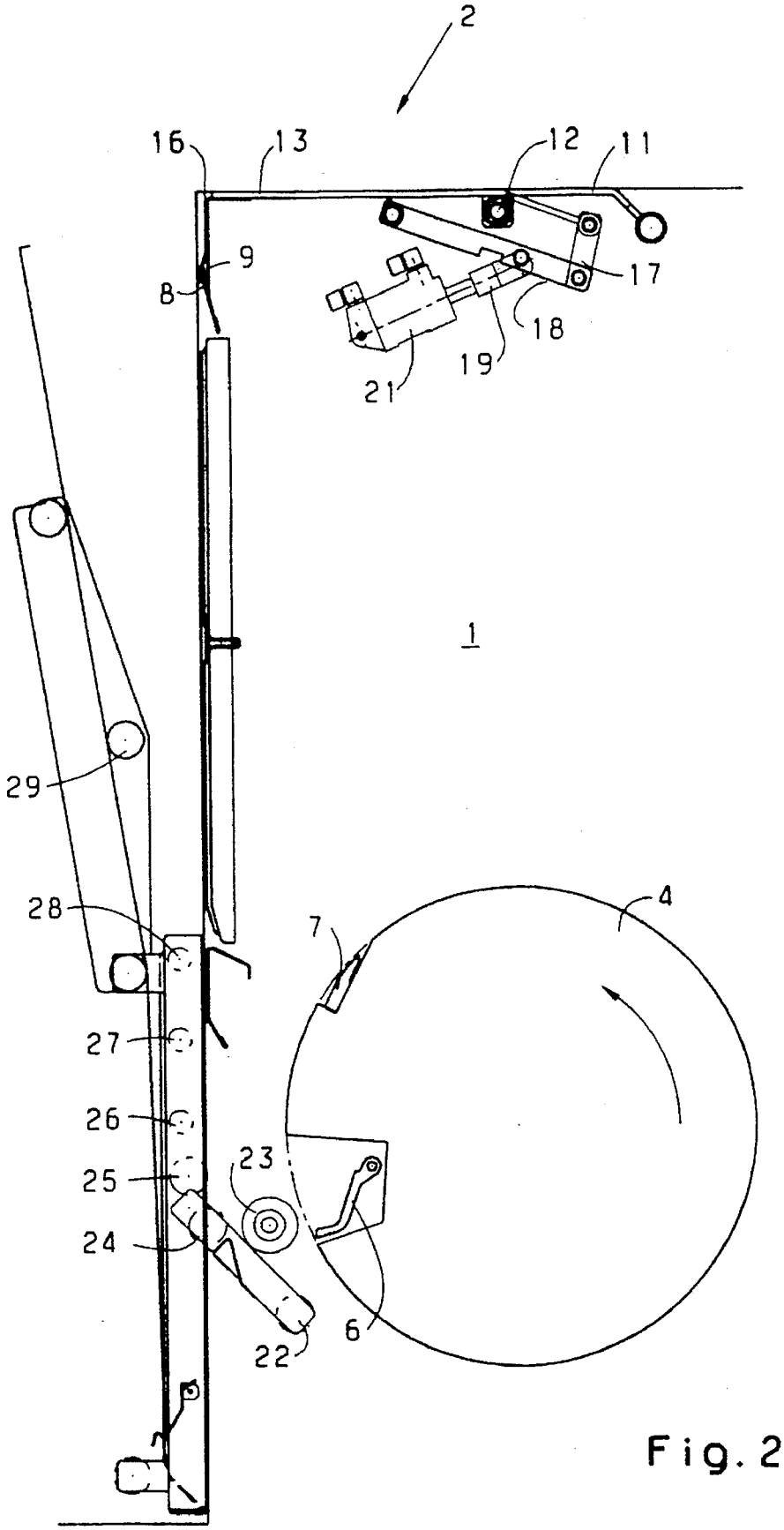
FIG. 2 is a view like that of FIG. 1 showing the printing plate holding device according to the invention in a "printing plate locking position"

For locking the printing plate 3, the work cylinder 21 is moved into a "locking position" wherein the piston rod 19 is driven outwardly. The actuating rod 19 swivels about the bearing bolt 12 until the cover 16 comes into contact with the hook 8, and the hook 8 is in alignment with the actuating rod 11 (FIG. 2). The end of printing plate 3 is thereby locked in the hook 8.

Figure 3:
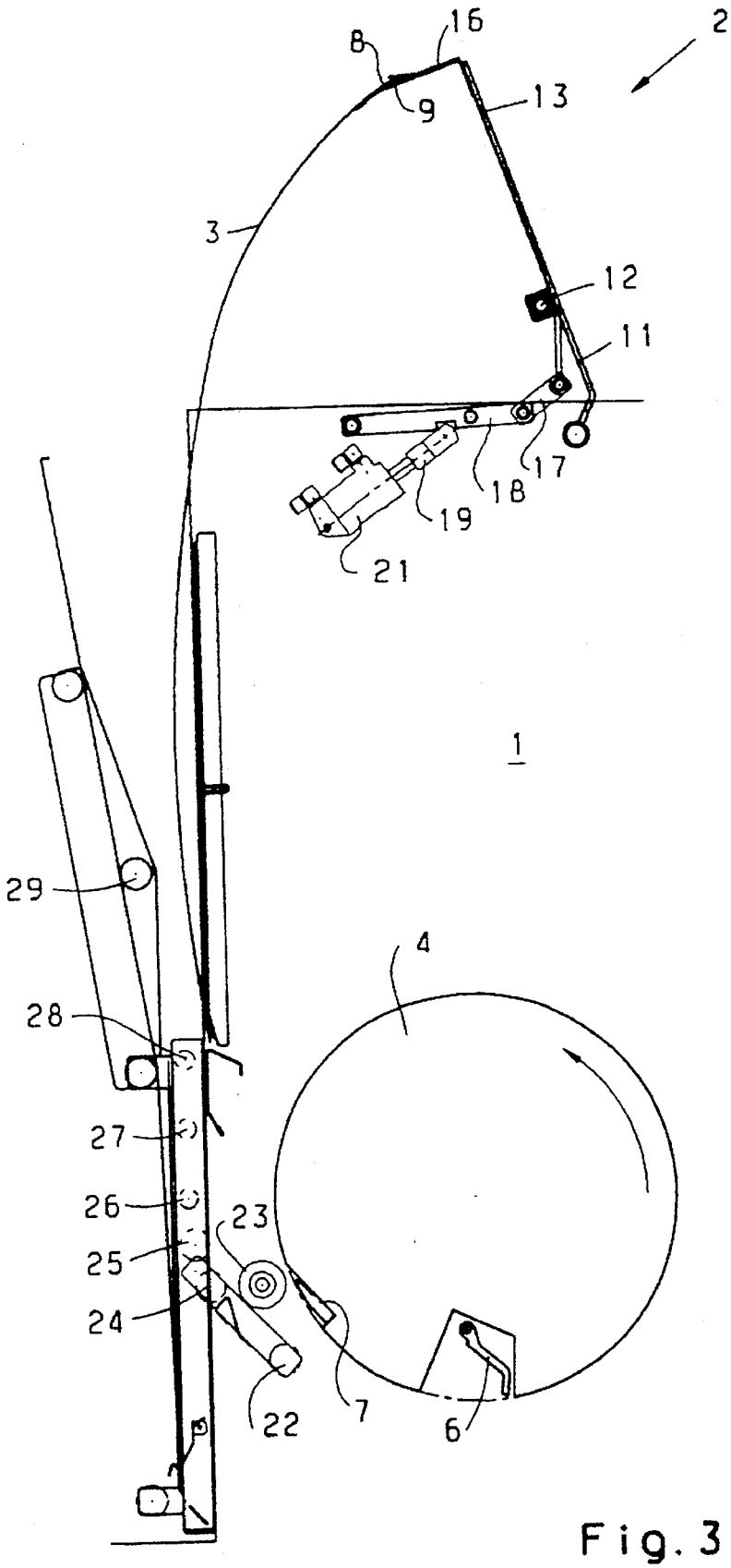
FIG. 3 is a view like those of FIGS. 1 and 2 showing the printing plate holding device according to the invention in a "printing plate holding or retention position".

To pull the printing plate 3 off the plate cylinder 4 and pull it out of an access to the plate cylinder 4, a "holding or retention position" is attained upon further outwardly driving the piston of the work cylinder 21. The actuating levers 11 and 13 swivel jointly upwardly about the bearing point 10 through an angle _(for example, _=70°). By this provision, the printing plate 3 is pulled all the way out of the printing unit tower 1 and brought into a "holding or retention position" (FIG. 3) in which, in the region of the printing unit tower 1, is disposed substantially vertically and parallel thereto.

I claim:

1. In combination, a rotary printing press having a plate cylinder, and a device for pulling off and holding a printing plate removed from the plate cylinder of the rotary printing press, the rotary printing press comprising a printing unit tower containing the respective plate cylinder, the pull-off and holding device being disposed on said printing unit tower and including a take-up element for a leading and trailing edge, respectively, of the printing plate, a locking element cooperatively engageable with said take-up element, adjusting members engageable with said take-up element and said locking elements for shifting said take-up element and said locking element between a "take-up position" and a "holding position", said adjusting members including a first actuating lever carrying said locking element at a free end thereof, and a swivelable second actuating lever carrying said take-up element.

2. Device for pulling off and holding a printing plate according to claim 1, wherein said adjusting members further include a swivelably supported work cylinder, a swivelably supported control lever, and a coupler disposed on said control lever.

3. Device for pulling off and holding a printing plate according to claim 1, wherein said first and said second actuating levers are supported so as to be swivelable counter to one another.

4. Device for pulling off and holding a printing plate according to claim 1, including guide elements mounted on said printing unit tower for feeding the leading and the trailing edge, respectively, of the printing plate to said take-up element.

5. Device for pulling off and holding a printing plate according to claim 1, wherein said take-up element is a hook.

6. Device for pulling off and holding a printing plate according to claim 1, wherein said take-up element is a hook formed with an opening, and said locking element is a cover for covering said opening.

* * * * *